United States Patent [19]

Fainman

[11] 4,105,542

[45] Aug. 8, 1978

[54] METHOD FOR REMOVING SLUDGE FROM OIL

[76] Inventor: Morton Fainman, 11200 Homedale St., Los Angeles, Calif. 90049

[21] Appl. No.: 755,638

[22] Filed: Dec. 30, 1976

[51] Int. Cl.[2] ..... C10M 11/00

[52] U.S. Cl. ..... 208/180; 208/181

[58] Field of Search ..... 208/180, 181

[56] References Cited

U.S. PATENT DOCUMENTS

| | | | |
|---|---|---|---|
| 2,294,461 | 9/1942 | Jones | 208/180 |
| 2,339,520 | 1/1944 | Riesmeyer | 208/180 |
| 3,819,508 | 6/1974 | Fainman et al. | 208/181 |
| 3,835,035 | 9/1974 | Fainman | 208/181 |

*Primary Examiner*—Herbert Levine

*Attorney, Agent, or Firm*—Spensley, Horn & Lubitz

[57] ABSTRACT

This invention relates to a method for purifying used oil such as lubricating oil and the like. The method comprises the steps of mixing the used oil with a diluent so as to lower the viscosity of the used oil to a manageable viscosity, and then mixing and heating the diluted oil with a water-alcohol mixture which mixture also includes a small quantity of water soluble acid or a monovalent base. The resultant mixture is then permitted to settle so as to cause a phase separation with the sludge and other undesirable components in the aqueous phase and the now-purified oil in the organic phase.

36 Claims, No Drawings

METHOD FOR REMOVING SLUDGE FROM OIL

BACKGROUND OF THE INVENTION

1. Field of the Invention

The present invention relates to methods of purifying oils, and more specifically, to an improved method for purifying used lubricating oils.

2. Prior Art

The reliance on petroleum products in industrialized nations is well recognized. This has led many countries, including the United States, to spend substantial sums in terms of exploration and development of oil wells in order to meet the needs of industry. However, notwithstanding such efforts by many countries, the demand for oil continues to outstrip the supply and has led to substantially increased costs of the oil as well as the goods made therefrom. Another factor which adversely effects the supply of oil is the problems of obtaining the oil from the earth without causing damage to the environment. Recent legislation in various countries throughout the world has limited the methods of oil exploration such that the environment is not adversely effected. This too has increased the costs of oil and, in some situations, has decreased the efficiency of operating existing oil wells. In response to this problem, the prior art has disclosed many methods for reprocessing used oil rather than discard it so as to recycle the used oil in an attempt to meet the ever increasing demand for oil. If such recycling methods are relatively effective, the reprocessed oil can be used directly in place of new oil, thus decreasing the demand for new oil.

In one method of treatment which has been used in the prior art, the used oil is first treated with a caustic compound at an elevated temperature to drive off water and to break the various soaps in the oil as well as to neutralize the oil. In the course of heating, the light ends of the oil are flashed off and are generally burned. After the heating procedure, the oil is then cooled and a small quantity of concentrated sulfuric acid is added. After settling, the bottoms are drawn off which contain an acid sludge comprising sulfuric acid, dissolved sulfonates and oxygenated hydrocarbon. This sludge, which may constitute 5 to 20% by weight of the used oil being treated, is disposed of by being placed in a container to prevent the acid fumes from escaping and is then dumped in an appropriate manner. It should be noted, however, that due to the noxious properties of the acid sludge, it is presently very difficult to dispose of such sludge in a manner which is environmentally acceptable. After removal of the acid sludge from the oil, the top oil is then generally heated and finely divided clay is added. The mixture of clay and top oil is then further heated and cooled and finally passed through a filter press. This procedure gives the yield only of about 50% reclaimed oil based on the weight of the used oil originally treated. Moreover the procedure produces large quantities of acid sludge which, as hereinabove described, is difficult to dispose of properly. Finally, the procedure requires substantial heating and other type procedures which add to the expense of such method. This type of method is generally described in U.S. Pat. No. 2,319,598.

Yet another method for treating oil is disclosed by Chambers, et al., U.S. Pat. No. 3,625,881. As a preliminary treatment, Chambers, et. al. pretreat the used oil feedstock to remove substantial quantities of water. This is done by flash vaporization of the feedstock at a temperature below its coking point. After flash evaporation of the feedstock, Chambers, et al. then admix the dried feedstock with concentrated aqueous alkali metal hydroxide and also with additional oil at a temperature of about 200° to 300°. After mixing, the mixture is fed to a centrifuge where a liquid effluent is separated from carbonaceous material in the original feedstock. Thus, it is fair to say that Chambers, et al. method deals primarily with an involved distillation procedure for reclaiming used crankcase oils, which is expensive and time consuming.

A still further method is disclosed by Great Britain Pat. No. 742,909. The British patent is directed to the treatment of a lubricating oil derived from naphthenic crude oil. The process includes the steps of treating the mineral lubricating oils with a aqueous extracting agent and then contacting the treated oil countercurrently in a second zone with water, recovering the washed oil for drying and further refining, and recovering the alcohol from the aqueous extracting agent and collecting the aqueous residue. Because such method contemplates the use of countercurrent mixing, it is at odds with processes, such as that disclosed herein, wherein such countercurrent mixing would work against the settling of the various sludges, soaps and the like. Other further prior art methods of refining crude oil are disclosed in U.S. Pat. No. 2,376,418; U.S. Pat. No. 3,639,229; and U.S. Pat. No. 3,449,243.

As seen from the above methods, while there are many methods which are effective to some extent in the purifying of used lubricating oils, they are relatively expensive, require complex equipment, and produce acid sludges which are difficult to dispose of properly. In response to these problems, two methods have been disclosed which tend to overcome these problems associated with the prior art. These methods are disclosed in U.S. Pat. No. 3,819,508 and U.S. Pat. No. 3,835,035. In the methods disclosed in these patents, the used lubricating oil is mixed with a soluble, predominantly hydrocarbon diluent. The diluted lubricating oil is mixed with a miscible alcohol and water mixture which contains in solution a small amount of either an acid or a base. The diluted lubricating oil-alcohol water mixture is then centrifuged to remove sludge and metal compounds from the oil. Such centrifugation causes the formation of a diluted oil phase and a water-alcohol phase. The problem associated with this type of method is that centrifugation is an expensive process and is the limiting factor on the quantities of oil which can be processed. Moreover, if large quantities of sludge and other undesirable components are contained within the oil, the efficiency of the process decreases and the percent of recoverable oil obtained from centrifugation decreases. The present invention represents an advancement over the two methods discussed hereinabove and contains none of the aforementioned shortcomings associated with the other prior art production methods. The present invention includes unique ordered steps which enables the present method to alleviate the need for centrifugation and thus substantially reduces costs and improves the reliability of equipment associated with all prior art methods. In addition, by the use of the method of the present invention, increased yields are also achieved over many prior art methods.

BRIEF SUMMARY OF THE INVENTION

The present invention relates to methods for purifying oil, and more specifically, to a method for purifying used lubricating oil having a high content of sludge and other undesirable components. The present method for purification of used oil is extremely economical and provides a yield of about 95% or more of the recoverable organic material in the used oil. It also produces a very small amount of residue composed of polyvalent metal compounds in admixture with oxidised hydrocarbon and all of the other various materials which are found in the sludge of used lubricating oils. The present method provides a solution to the above denoted environmental pollution problems in connection with the dumping of waste oils in that it is an effective treatment for such waste oils and provides a new source of high viscosity index oils which are extremely pure and directly useable in industry.

The present method for purifying used oils, such as lubricating oils, and the like, which used oils contain sludge, metal-containing compounds and other undesirable components and mixtures thereof, is achieved by the following steps.

First, the used oil is mixed with a hydrocarbon diluent so as to dilute the used oil into a workable viscosity. It has been found that in typical used oil compositions, the ratio of hydrocarbon diluent to used oil is approximately 4 to 1 to 1 to 2 by volume. After the oil is diluted, it is mixed with a water-alcohol mixture comprising (i) an alcohol; (ii) water, and (iii) a member selected from the group consisting of water soluble acids and water soluble bases. The diluted oil is mixed with the water-alcohol mixture in a ratio of about one to four volumes of water-alcohol mixture for each volume of used oil processed at a temperature in the range from about above ambient to below the boiling point of the water-alcohol mixture, and more preferably from about 40° C to below the boiling point of the water-alcohol mixture. The heated mixture is then permitted to settle for a sufficient length of time so as to cause a separation with substantially all of the sludge and metal compounds dissolved and suspended in the water-alcohol and the now-purified diluted oil in an upper separated organic phase. For the purposes of this invention, the water-alcohol mixture containing the sludge and the like is referred to herein as the water-alcohol phase. It should be noted, that one of the most important advantages and a point of novelty of the present invention is that there is no need to centrifuge the oil after it is treated with the water-alcohol mixture; rather, all that is necessary is to heat the mixture and then permit the heated mixture to settle. This enables the present invention to do away with prior art centrifugation methods which were neither efficient nor reliable for lubricating oils having high sludge contents as well as the expense associated therewith.

The novel features which are believed to be characteristic of the invention, both as to its organization and method of operation, together with further objectives and advantages thereof, will be better understood from the following description in which a presently preferred embodiment of the invention is illustrated by way of example. It is to be expressly understood, however, that the examples are for the purpose of illustration and description only and are not intended as a definition of the limits of the invention.

DETAILED DESCRIPTION OF THE INVENTION

Under the present method, used lubricating oils, such as those obtained from service stations and the like, are first mixed with a predominantly hydrocarbon liquid diluent which preferably has a boiling range within the temperature region of from about 40° to about 275° C. The liquid diluent may either be an aromatic or aliphatic hydrocarbon which is mutually soluble with the used hydrocarbon lubricating oil. The function of the liquid diluent in the present method, is to lower the viscosity of the used lubricating oil and to change the characteristics of the used lubricating oil dispersion so as to thereby facilitate the contact of the used oil with the subsequent steps, and more specifically, with the step of mixing such diluted used oil with a water-alcohol mixture. It is understood, however, that while various hydrocarbon diluents can be used, such diluents, such as recyled light ends from the purified lubricating oil, may contain other components up to a content of about 10 percent by weight. The quantity of the liquid diluent which is employed in diluting the used lubricating oil varies in accordance with the process. It has been found that a useful range of the liquid diluent to used oil is from about 1 to 1 to about 1 to 2 by volume, although other ranges may be used, such as, for example, 2 to 1 or even 4 to 1 depending on the solids content and viscosity of the used oil undergoing treatment. Of course it is desirable to use the smallest amount of diluent possible since an increase in the amount of a diluent makes the subsequent separation of the diluent and the oil more involved and costly. However, unlike the method disclosed in U.S. Pat. No. 3,835,035 and U.S. Pat. No. 3,819,508 where an increase in the amount of diluent meant that efficiency of the centrifugation in terms of percent recovery was substantially decreased, under the present method, adding more diluent does not produce the same substantial problems in that no centrifugation is necessary in order to separate the sludge and other ingredients from the used oil.

Next, the now diluted oil is contacted with a mixture of water, a water miscible alcohol, and a small quantity of a member select from the group consisting of a water soluble acid or a water soluble, monovalent base, and in the preferred embodiment simultaneously heated to about 40°–80° C. It is presently believed that the acid/-base functions to displace polyvalent metal ions from the various metallic soaps which are present in the diluted lubricating oil undergoing treatment. In the case of an acid, as the polyvalent metal ions are displaced from the soaps by hydrogen ions, the soaps are converted into lower molecular weight acids. The acids formed have a relatively low molecular weight and the solubility of the resulting acids is thus decreased while their solubility in the water-alcohol phase is increased. In the case of a base, as the polyvalent metal ions are displaced from the soaps by the monovalent cations preferably derived from water soluble ammonium or alkali metal bases, the molecular weight of the soaps is decreased. The lower molecular weight soaps are not as soluble in the oil, but are now more soluble in the water-alcohol mixture.

This phenomena is believed to facilitate the extraction of the metal soaps from the diluted lubricating oil through contact with the water miscible alcohol-water mixture. Thus, the resultant change in the dispersant composition of the oil phase releases the peptized solids which then readily settle from the heated mixture by gravity settling.

Among the water miscible alcohols which may be used in the present invention are methanol, ethanol, isopropyl alcohol, n-propyl alcohol, sec-butyl alcohol, and tert-butyl alcohol. The higher alcohols, such as amyl alcohol and butyl alcohol, have such a low solubility in water that they are not generally effective in the present invention. The water miscible alcohols which are within the scope of the present invention are water miscible alcohols including polyhydric alcohols having a solubility of about twenty percent or more by volume in water. Of the various alcohols used, it was found that isopropyl alcohol functioned best in the performance of the process. It was also found that the water-alcohol mixture containing from about 40 to 60% by volume of alcohol was generally more effective than mixtures containing either more or less alcohol in relation to the amount of water in the alcohol-water mixture.

It should be noted that the present invention is directed towards the treatment of used lubricating oils. This is a specific type of oil which is not a homogeneous material. Rather, such oil may contain a relatively high water content and various contents of sludge which in turn may contain a whole host of undesirable components. The specific components of the lubricating oil, including its viscosity are factors which are taken into consideration in determining the ratio of alcohol to water in treating the used oil as well as the amount of hydrocarbon diluent as hereinabove described.

In determining the optimum process conditions for particular used oil, the lubricating oil is analyzed with a view to determining the optimum process conditions for treating the used oil. By way of example, the behavior of the sample may be determined in considering how much of the predominantly liquid hydrocarbon diluent should be used, as well as the ratio of water-alcohol mixture to diluted oil.

It has been determined that suitable quantities of the water-alcohol mixture to raw used oil is about two volumes of the water-alcohol mixture for each volume of oil, i.e. 2 to 1. The diluted lubricating oil may be subjected to multi-stage extraction with the water-alcohol mixture as is known in the art, and in addition, the quantity of the water-alcohol mixture may be varied from about 1 to 1, to 4 to 1 based upon the volume of used oil processed. In general, the volume of water miscible alcohol water mixture is kept as low as possible in order to reduce costs. Of the various acids which are within the scope of the invention, it has been found that preferably inorganic acids are used. Such acids are well-known in the art and include, for example, hydrochloric acid, sulfuric acid, and phosphoric acid. It is believed that the decomposition of the polyvalent metal soaps and the removal of the organic acids from the organic layer to the water-alcohol layer reduces the efficacy of the non-ionic dispersants remaining in the oil to maintain the micellular configuration necessary to keep the solids and sludge in dispersed form in the diluted oil. In displacing polyvalent metal ions with hydrogen ions to convert soaps in the treated oil to lower molecular weight acids, the displaced metal ions form salts with the anionic portion of the treated acid. To promote the migration of such salts into the water-alcohol phase, the treating acid is preferably one which does not contain a bulky anionic group, e.g. a sulphonic acid group which would enhance the solubility in the oil phase of salts formed with the displaced polyvalent metal ions and thereby inhibit migration of such salts into the alcohol-water phase. In general, the quantity of the acid which is used is sufficient to displace the polyvalent metal ions from the soaps within the oil. As an example, in treating a diluted used lubricating oil by mixing with one volume of the 50–50 volume ratio water miscible alcohol-water mixture, it was found that the use of 3 milliliters of an acid, e.g. concentrated hydrochloric acid, for each 100 milliliters of the alcohol-water mixture gave satisfactory results.

It has also been found that bases also function in the process in the same manner as acids, i.e. reacting with the soaps to cause displacement of the polyvalent metal ions, usually bivalent, with monovalent ions and thereby convert the soaps in the treated oil to lower molecular weight soaps. Various water soluble ammonium and alkali metal bases have been found to be the most advantageous bases used. For example, ammonium carbonate, sodium carbonate, potassium carbonate, lithium carbonate, and sodium hydroxide have all been employed and found suitable. Of the various bases which have been employed, sodium carbonate and sodium phosphate are preferred. Again, although not to be bound by any theory, it is believed that the carbonate and phosphate anions are particularly effective in reducing the solubility of the polyvalent metal cations which are displaced from the metal soaps in the diluted lubricating oil by the monovalent ammonium and alkali metal ions, and in reducing the efficacy of the non-ionic dispersants remaining in the oil to maintain the micellular configuration necessary to keep the solids in sludge in disperse form in the diluted oil. It has been found that the use of excessive quantities of the water soluble alkali base actually causes a reduction in the overall efficiency of the process in that it produces a purified oil whose ash content is higher than that which is obtained through use of smaller quantities of the base. When excessive quantities of the monovalent cation base are employed, the additional sodium from the sodium carbonate is believed to be taken up by the non-ionic detergents in the used oil. As a result, the purified oil obtained from the process will have a higher metals content than that obtained by using a lesser quantity of the alkali base metal. For the above reasons, it is preferred that the quantities of the ammonium or alkali metal base which is used in sufficiently quantity to displace the polyvalent metal ions from the soaps within the oil, but that the base not be present in any great excess of that amount. For example, in the treatment of a diluted used lubricating oil by mixing one volume of a 50—50 volume ratio water miscible alcohol-water mixture, it was found that the use of one gram of alkali base metal, e.g. sodium carbonate, for each 100 milliliters of the alcohol-water mixture gave satisfactory results.

In the preferred embodiment, agitation is generally employed during the treatment of the diluted lubricating oil with the water-alcohol mixture containing either the base or the acid. For example, agitation may be provided by mixing the water-alcohol mixture with the diluted oil in a large metal vessel with a "Lighting" mixer or other similar mixing device, or it can be mixed in a gear pump or homogenizer such as is well known in the art. The agitation of the diluted lubricating oil and water-alcohol mixture is generally carried out until an emulsion forms which indicates that the diluted oil has been thoroughly contacted with the water-alcohol mixture.

In the prior art, such emulsion was broken during the subsequent step of centrifugation. However, as discussed hereinabove, such centrifugation step required the expenditures of substantial time and limited the quantities which could be processed. In the present invention, rather than centrifugation, the mixture of water-alcohol and diluted oil is subject to a heating step in which the resultant mixture is heated to a temperature of from about 40° to about 80° C.

While the preferred embodiment simultaneously heats and mixes the mixture of water-alcohol and diluted oil, it has been found that mixing first and then heating also produces the hereinafter described desirable results. One could also heat each component and then mix them together if desired so long as the resultant mixture is about 40°-80° C. In any event, all three possible combinations of heating/mixing are within the scope of the present invention.

A satisfactory separation then occurs upon standing for 24 hours at room temperature (20°-25° C). After settling, two phases form: a water-alcohol phase (the aqueous phase) which contains all of the sludge depositing out in the water-alcohol mixture, and an organic phase with the oil and hydrocarbon diluent therein. Maintaining the heated mixture at 40°-80° C has been found to further aid in the separation and decrease the time necessary to form a phase separation. The water-alcohol phase which is taken off contains ammonium or alkali metal soaps if a base is used and free acids if an acid is used. Depending on the soap content of the alcohol-water mixture, the mixture of alcohol and water may be recycled directly to the process for use in treatment of additional used lubricating oil diluted with the hydrocarbon hereinabove described. However, the water-alcohol phase may also first be subjected to a cleaning up operation before returning to the process. Any conventional procedure may be used for cleaning the water-alcohol phase to remove alkali metal soaps or free organic acids such as by acidification and extraction of the organic acids or by ion exchange. Distillation of the alcohol results in separation of most of the organic impurities and sludge from the residual water which may be reused.

In order to determine the efficiency of the present method the ash content of the lubricating oil obtained after settling is compared to the ash content of the used lubricating oil. Based on experiments carried out with a number of used lubricating oils obtained from various sources, the present process provides a reduction in the ash content of the oil of from about 80-90%. For example, an ash content of about 2% in the used lubricating oil as it is received was reduced to about 0.2% in the purified oil. The residue from the process which contains the various materials that are present in the sludge of a lubricating oil may constitute about 3% by weight of the used lubricating oil as it is received. Thus, the residue is only a very small fraction of the weight of the used lubricating oil. By greatly reducing the weight of the residue removed from the used lubricating oil during purification, the method of the present invention does not present the problems of waste disposal which have plagued previous attempts to process used lubricating oil. The residue from the process has a high metal content, predominantly lead, and thus represents a potentially valuable source of metals. In view of the large quantity of used lubricating oil which is generated from automobiles, the method of the present invention could produce quite sizable quantities of metals.

The examples described in the following tables were generally conducted by mixing 50 milliliters of used drain oil with 50 milliliters of V M & P naphtha. After mixing drain oil with diluent, the diluted oil was then admixed with 100 milliliters of 50% volume isopropyl in water containing either 1 gram of sodium carbonate or 3 milliliters of concentrated hydrochloric acid, thoroughly agitated, at the indicated temperature, and 100 milliliters of the resulting emulsion was poured into a 100 milliliter graduated cylinder where it was permitted to gravity settle for 24 hours.

Upon completion, the contents of the container had two phases. The lower layer was an emulsion containing the sludge in the water miscible alcohol-water layer. Above this phase was an organic layer containing the purified organic phase of the predominantly hydrocarbon liquid diluent with the purified drain oil therein.

After settling, as described above, a sample is removed from the organic phase using a 50 milliliter syringe fitted with a 8 inch needle. The sample from the organic phase was then analyzed to determine its solids content and the content of the solids. The ash content of the purified drain oil (solids basis) was then compared to an ash content of the original drain oil (solids basis). This then permitted a direct evaluation of the efficacy of this invention in terms of the percentage reduction which was obtained in the ash content.

In determining the percentage of solids in the drain oil or the purified organic layer, a 10 gram sample was weighed into a soft, crimped aluminum dish having a diameter of $2\frac{3}{8}$ inches, a depth of $\frac{5}{8}$ inches and a finger-grip handle. The dish was placed on a Corning Pyroceram 600-watt hotplate with a temperature dial set to produce a surface temperature of approximately 450° F and preheated to the operating temperature. Heating at about 450° F was maintained for 1 hour, after which the dish was removed, cooled to ambient temperature, and reweighed. The percent of solids was then determined by dividing the final weight of the residue by the weight of the sample and multiplying by 100.

The ash content of the drain oil or the purified organic layer was determined by ASTM method D482-63. In determining ash, the analytical problems which are associated with the presence of phosphorus and lead compounds were disregarded since the results were used on a comparative basis. In other words, any error produced by the presence of phosphorus or lead would have similar effect in the ash analysis of the used drain oil as in the ash determination for the purified organic liquid. Thus, the errors, if any, would not affect the validity of the comparison of the ash content of the used drain oil with that of the purified organic liquid.

The method of determining ash consists of weighing a sample of the material to be ashed into a 30 ml. procelain crucible. The material in the crucible is then ignited and allowed to burn until only ash and carbon remain. The carbonaceous residue is then reduced to an ash by heating in a muffle furnace at 775° C, followed by cooling and weighing. As determined by this method, the ash content primarily indicates the metals contents of the sample expressed in terms of the inorganic salts of the metals which are predominantly phosphates, oxides, silicates, sulfates, etc.

In determining the ash content of the purified drain oil corrected to the weight of the used drain oil, the solids contents and the ash content of the used drain oil were determined as a percentage of the weight of the drain oil sample. The ash content of the purified organic layer was also determined as a percentage based on the solids content of the sample from the purified organic layer. Conveniently, the weight of solids of the purified organic layer was determined and these solids were then burned to determine the ash content of the solids. The ash content of the purified organic layer, expressed as a percent of the solids in the sample, is then converted to weight percent ash based on the used drain oil by multiplying by the percent of solids in the used oil.

The basis for the conversion of the ash in the purified organic layer to percent ash based on the used drain oil is based on the fact that the ash is contained in the solids and the total solids content of both the drain oil and the purified orgnaic layer is relatively constant and is only slightly affected by the present process. In the course of heating at about 450° F to determine solids, the liquid hydrocarbon diluent in the sample from the purified organic layer is driven off. Thus, the solids which remain are those obtained from the used drain oil being treated. Likewise, in determining solids in the used drain oil, the heating at about 450° F drives off the light fractions as well as any water present in the drain oil. The solids which remain are largely hydrocarbons which have a boiling point in excess of 450° F, and these solids are almost entirely recovered by the present process.

The solids content changes slightly as a result of the present process since the sludge and metals which are removed from the used drain oil are solids. However, the weight of the solids which are removed is very small in comparison to the total weight of solids composed mainly of hydrocarbons whose boiling point is in excess of 450° F. For these reasons, the assumption that the solids content from the drain oil remains fixed throughout the process is reasonably valid and any errors resulting from this approximation are within an error of about 5 percent of the observed values, i.e., ±0.05 times the observed values.

The efficiency of phase separation was determined by further removing an additional 20 milliliter sample of the organic phase and centrifuging for 4 hours. The method of centrifuging used was a modification of ASTM method D1796-62. The cone shaped tubes containing 20 milliliter of the organic phase were then whirled in a Precision Oil Centrifuge (Catalog No. 67343) to produce a relative centrifugal force of 800 at the tips of the tubes.

The percent of the aqueous layer and sludge still remaining was taken as an indication of the efficacy of the settling process. No layer indicated complete separation and 50% would indicate no separation.

TABLE I

Analysis of Used Lubricating Oils

| No. of Sample | Ash Content Used Oil, Wt. % | Solids Content Wt, %, 230° C/1 hr. | Ash Content of Solids, Wt. % |
|---|---|---|---|
| A | 0.85 | 71.4 | 1.19 |
| B | 1.73 | 81.6 | 2.12 |
| C | 1.23 | 80.7 | 1.52 |

TABLE II

Removal of Sludge Using Sodium Carbonate

| No. of Sample | Mixing Temperature ° C | Settling Temperature ° C | Wt.% Ash Organic Layer (Solids) | Centrifuged Organic Layer: Vol. % Aqueous Layer | Centrifuged Organic Layer: Wt.% Ash Organic LYR (Solids) |
|---|---|---|---|---|---|
| A | 30 | 23 | 0.52 | 10 | 0.26 |
| | 40 | 23 | — | 7 | — |
| | 50 | 23 | — | 6 | — |
| | 60 | 23 | — | 6 | — |
| | 70 | 23 | — | 4 | — |
| | 70 | 70 | 0.27 | 3 | 0.26 |
| | 80 | 23 | — | 4 | — |
| | 80 | 70 | — | 3 | — |
| B | 40 | 23 | — | 35 | — |
| | 50 | 23 | — | 29 | — |

TABLE II-continued

Removal of Sludge Using Sodium Carbonate

| No. of Sample | Mixing Temperature ° C | Settling Temperature ° C | Wt.% Ash Organic Layer (Solids) | Centrifuged Organic Layer: Vol. % Aqueous Layer | Centrifuged Organic Layer: Wt.% Ash Organic LYR (Solids) |
|---|---|---|---|---|---|
| | 60 | 23 | — | 24 | — |
| | 70 | 23 | 0.53 | 23 | 0.36 |
| | 70 | 70 | 0.34 | 7 | 0.29 |
| | 80 | 23 | — | 3 | — |
| C | 40 | 23 | — | 53 | 0.26 |
| | 40 | 70 | — | 8 | — |
| | 50 | 23 | — | 52 | — |
| | 60 | 23 | — | 53 | — |
| | 70 | 23 | — | 50 | — |
| | 70 | 70 | 0.33 | 7 | 0.26 |
| | 80 | 23 | — | 36 | — |

TABLE III

Removal of Sludge Using Hydrochloric Acid

| No. of Sample | Mixing Temperature ° C | Settling Temperature ° C | Wt.% Ash Organic Layer (Solids) | Centrifuged Organic Layer: Vol. % Aqueous Layer | Centrifuged Organic Layer: Wt.% Ash Organic LYR (Solids) |
|---|---|---|---|---|---|
| A | 40 | 23 | 0.45 | 10 | 0.28 |
| | 70 | 70 | 0.28 | 4 | 0.27 |
| B | 40 | 23 | — | 30 | 0.34 |
| | 70 | 70 | 0.33 | 5 | 0.32 |
| C | 40 | 23 | — | 52 | 0.28 |
| | 70 | 70 | 7 | 8 | 0.28 |

As indicated in the above tables, the present process was effective in reducing the content of all the various metals found in drain oil. The presence of metal in a used lubricating oil makes the oil very difficult to treat by conventional refinery processes. By greatly reducing the metals content of the used lubricating oil in accordance with the present method, the resulting oil may then be treated further using conventional refinery processing, such as distillation, hydrotreating and the like.

As illustrated in the foregoing discussion and the following examples, the present process provides a economic and ecologically acceptable solution to the long standing problem of recycling used lubricating oils. Thus, the use of the process will make a substantial contribution to environmental quality by providing a reduction in pollution of the air or water from the burning or disposal of used lubricating oils. Further, the present invention represents a substantial contribution to the conservation of natural resources since it enables the reuse of relatively scarce high viscosity index oils which are needed for automotive lubrication. Finally, the present invention does away with the centrifugation step taught in prior art methods which step is both expensive and limiting in terms of the amount of used lubricating oil which may be processed. By the present invention, the substantially less expensive and more simple heating step enables the used lubricating oil to produce the necessary phase separations enabling removal of the undesirable ingredients by gravity separation. It should be therefore understood, that while the preferred examples described herein show the specific use of acids and bases, it will be apparent to those skilled in the art that other changes and modifications can be made without departing from the spirit or scope of the present invention as defined and claimed herein. For example, after the settling step, the organic phase can be drawn off and centrifuged. Centrifugation at this point is now much more efficient than as described in the prior art as the bulk of the water-alcohol phase and sludge has already been removed. Since the water-alcohol mixture is usually one-half the total volume, only one-half the centrifuge capacity is required for liquid-liquid separation. Moreover, centrifuging the organic layer (after the settling) reduces the content of insoluble impurities which must be removed by centrifugation, markedly reducing the cost and improving the efficiency of the separation far beyond the methods of the prior art.

What is claimed is:

1. A method for purifying used oil such as lubricating oil, said used oil having sludge, metal containing compounds, other undesirable components and mixtures thereof contained therein by the steps of:

(a) mixing said used oil with a hydrocarbon diluent so as to dilute said used oil;

(b) mixing said diluted used oil with a water-alcohol mixture comprising (i) a water miscible alcohol, (ii) water, and (iii) a water soluble acid;

(c) heating the resultant mixture formed from steps (a) and (b) to a temperature of from about 40° to 80° C; and (d) permitting the now-heated resultant mixture to settle for a sufficient length of time so as to cause a phase separation with the sludge and metal containing compounds in one phase and the now-purified diluted oil in another phase.

2. The method of claim 1 wherein said hydrocarbon diluent has a boiling range within the temperature region of about 40° to about 275° C.

3. The method of claim 1 wherein the ratio of hydrocarbon diluent to used oil is about 4:1 to 1:2 by volume.

4. The method of claim 1 wherein the quantity of said acid present in said alcohol mixture is sufficient to displace metal ions from said metal containing compounds contained in the said used oil.

5. The method of claim 3 wherein said water-miscible alcohol is selected from the group consisting of methanol, ethanol, isopropyl alcohol, n-propyl alcohol, sec-butyl alcohol or tert-butyl alcohol.

6. The method of claim 1 wherein said water-miscible alcohol-water mixture contains from about 40 to about 60% by volume of the alcohol.

7. The method of claim 3 wherein about one to about four volumes of said water-alcohol mixture is employed for each volume of said used oil.

8. The method of claim 1 further comprising the step of (e) centrifuging the phase containing the now-purified diluted oil after said settling step so as to further remove any undesirable components remaining therein.

9. The method of claim 1 wherein step (b) and (c) are conducted substantially simultaneously.

10. The method of claim 9 wherein the ratio of hydrocarbon diluent to used oil is about 4:1 to 1:2 by volume.

11. A method for purifying used oil such as lubricating oil, said used oil having sludge, metal containing compounds, other undesirable components, and mixtures thereof contained therein by the steps of (a) mixing said used oil with a hydrocarbon diluent so as to dilute said used oil, the ratio of hydrocarbon diluent to used oil being 4:1 to 1:2 by volume;

(b) mixing and heating said diluted oil with a water-alcohol mixture to form a resultant mixture, said water-alcohol mixture comprising:

(i) an alcohol;

(ii) water; and (iii) a water soluble acid in a ratio of about 1 to 4 water-alcohol mixture for each volume of used oil, said heating being to a temperature in the range from about 40° C to below the boiling point of said water-alcohol mixture; and (c) permitting the now-heated resultant mixture to settle for a sufficient length of time so as to cause a phase separation with substantially all said sludge and metal compounds in the water-alcohol phase and the now-purified diluted oil in a separate phase.

12. The method of claim 11 wherein said resultant mixture in step (b) is heated to a temperature of from about 40° to about 80° C.

13. The method of claim 11 wherein said hydrocarbon diluent has a boiling range within the temperature region of about 40° to about 275° C.

14. The method of claim 11 wherein the quantity of said acid present in said alcohol mixture is sufficient to displace metal ions from said metal containing compounds contained in the said used oil.

15. The method of claim 11 wherein said water-alcohol mixture contains from about 40 to about 60% by volume of said alcohol.

16. The method of claim 11 wherein about 1 to about 4 volumes of said water-alcohol mixture is employed for each volume of said used oil.

17. The method of claim 11 further comprising the step of (e) centrifuging said resultant mixture after said settling step so as to further remove any undesirable components remaining in the now-purified diluted oil phase.

18. The method of claim 11 wherein step (c) is conducted at a temperature in the range of from about 40° to 80° C.

19. A method for purifying used oil such as lubricating oil, said used oil having sludge, metal containing compounds, other undesirable components, and mixtures thereof contained therein by the steps of (a) mixing said used oil with a hydrocarbon diluent;

(b) mixing the now diluted used oil with a water-alcohol solution containing a small amount of a water soluble monovalent base;

(c) heating the resultant mixture to a temperature in the range from about 40° C to below the boiling point of said alcohol-water mixture; and (d) permitting the now-heated resultant mixture to settle for a sufficient length of time so as to cause a phase separation with substantially all said sludge and metal compounds in the water-alcohol phase and the now-purified diluted oil in a separate phase.

20. The method of claim 19 wherein said resultant mixture is heated in step (c) to a temperature of from about 40° to about 80° C.

21. The method of claim 19 wherein said hydrocarbon diluent has a boiling range within the temperature region of about 40° to about 275° C.

22. The method of claim 19 wherein said water-alcohol mixture contains from about 40 to about 60% by volume of the alcohol.

23. The method of claim 19 wherein about one to about four volumes of said water-alcohol mixture is employed for each volume of said used oil.

24. The method of claim 19 wherein steps (b) and (c) are conducted substantially simultaneously.

25. The method of claim 19 wherein said base is selected from the group consisting of sodium carbonate, potassium carbonate, and sodium phosphate.

26. A method for purifying used oil such as lubricating oil, said used oil having sludge, metal containing compounds, other undesirable components and mixtures thereof contained therein by the steps of (a) mixing said used oil with a hydrocarbon diluent so as to dilute said used oil;

(b) mixing said diluted oil with a water-alcohol mixture comprising (i) a water miscible alcohol, (ii) water, and (iii) a base selected from the group consisting of water soluble ammonium, alkali metal bases and mixtures thereof;

(c) heating the resultant mixture formed from steps (a) and (b) to a temperature of from about 40° to 80° C; and (d) permitting the now-heated resultant mixture to settle for a sufficient length of time so as to cause a phase separation with the sludge and metal containing compounds in one phase and the now-purified diluted oil in another phase.

27. The method of claim 26 wherein the ratio of hydrocarbon diluent to used oil is about 4:1 to 1:2 by volume.

28. The method of claim 26 wherein said water-alcohol mixture contains from about 40 to about 60% by volume of the alcohol.

29. The method of claim 26 wherein about one to about four volumes of said water-alcohol mixture is employed for each volume of said used oil.

30. The method of claim 26 further comprising the step of (e) centrifuging said resultant mixture after said settling step so as to further remove any undesirable components remaining in the now-purified diluted oil phase.

31. The method of claim 26 wherein the quantity of the ammonium or alkali metal base is sufficient to displace bivalent metal ions from the metal containing compounds contained in said used oil.

32. The method of claim 26 wherein said base is selected from the group consisting of sodium carbonate, potassium carbonate, and sodium phosphate.

33. The method of claim 26 wherein said base is sodium carbonate.

34. The method of claim 31 wherein the ratio of hydrocarbon dilutent is used oil is about 4:1 to 1:2 by volume.

35. The method of claim 26 wherein steps (b) and (c) are conducted substantially simultaneously.

36. The method of claim 26 wherein step (d) is conducted at a temperature of from about 40° to 80° C.

* * * * *

UNITED STATES PATENT AND TRADEMARK OFFICE

CERTIFICATE OF CORRECTION

PATENT NO. : 4,105,542

DATED : August 8, 1978

INVENTOR(S) : Morton Fainman

It is certified that error appears in the above-identified patent and that said Letters Patent are hereby corrected as shown below:

In column 10, Table 3, Sample C, in the column entitled "Wt.% Ash Organic Layer (Solids)", please delete "7" and insert in lieu thereof --0.37--.

Signed and Sealed this

*Fifteenth* Day of *May 1979*

[SEAL]

*Attest:*

RUTH C. MASON
*Attesting Officer*

DONALD W. BANNER
*Commissioner of Patents and Trademarks*